United States Patent [19]

Iaquinta

[11] 4,276,892

[45] Jul. 7, 1981

[54] SMOKING DEVICE WITH SELF CONTAINED LIGHTING APPARATUS

[76] Inventor: Joseph Iaquinta, 540 Rancho Ter., Escondido, Calif. 92025

[21] Appl. No.: 91,795

[22] Filed: Nov. 6, 1979

[51] Int. Cl.[3] ..... A24F 47/00

[52] U.S. Cl. ..... 131/185; 431/253

[58] Field of Search ..... 131/185, 7, 178, 234; 431/156, 253, 173

[56] References Cited

U.S. PATENT DOCUMENTS

| | | | |
|---|---|---|---|
| 1,704,091 | 3/1929 | Lozoff | 131/185 X |
| 2,398,695 | 4/1946 | Cloutier | 131/185 |
| 3,698,400 | 10/1972 | Tucker | 131/185 |

*Primary Examiner*—Stephen C. Pellegrino

*Attorney, Agent, or Firm*—Frank D. Gilliam

[57] ABSTRACT

A smoking device with a self lighting apparatus contained within the structure adjacent its hollow smokable substance containing bowl. The self lighting device comprises a pressurized fuel supply, a first delivery tube extending from the fuel supply and terminating adjacent the bowl, the first fuel delivery tube has a closed off end with a plurality of fuel passages around its end periphery, a second fuel delivery tube telescopes over the first fuel delivery tube, the second fuel delivery tube has a quantity of fiberous material contained in its outer end and a resilient material lining adjacent the fiberous material, the second delivery tube is translatable between a stowed position wherein its outer end is contained within the structure adjacent the bowl wherein the resilient material seals off the fuel passages and a fully deployed position wherein its outer end extends well into the bowl and fuel is supplied through the fuel passages to said fiberous material and an ignitor for igniting the fuel.

12 Claims, 5 Drawing Figures

10
12
14
16
18
20
22
24
25
26
27
28
32
34
38
40
42
44
60
62

30
32
34
35
36

30
32
34
35
36

30
32
34
35
36

32
38
40
42
44
46
48
50
51
52
54
56
57
58
60
25

SMOKING DEVICE WITH SELF CONTAINED LIGHTING APPARATUS

BACKGROUND OF THE INVENTION

The instant invention relates generally to improvements in smoking pipe apparatus and the like, and more particularly to a new and improved ignition system to be used in combination with smoking pipes and apparatus therefor.

In the field of smoking pipes, it has been the general practice to employ matches, conventional so-called cigarette lighters and other like devices to perform the operation of igniting a smokable substance within the bowl of the pipe by the application of same to the pipe bowl opening. Although such devices have served the purpose, they have not proved entirely satisfactory under all conditions of service for the reason that each of such devices is a separate item from the smoking pipe, but nevertheless a necessary element for igniting the smokable substance within the pipe bowl, and therefore must be remembered and carried on ones person at all times when smoking is desired. Furthermore, it has been disclosed in several earlier patents attempts to provide smoking devices with self contained ignitor systems. These devices attempted to improve the lot of the pipe smoker by providing various self contained means for igniting the smokable substances within the bowl. These devices had several drawbacks and have therefore never become a popular item for the pipe smoker. The principal drawbacks of these prior art attempts to combine the pipe and the lighter were: that the flame was remote from the substance to be ignited; the odor or taste of fuel was always present when the pipe was being smoked; the fuel supply evaporated as ignitor fuel was always exposed to the atmosphere; considerable mechanism was utilized when the ignitor apparatus was translated from a stowed to deployed position and the additional ignitor mechanism rendered the pipe cumbersome and difficult to carry on the person.

SUMMARY OF THE INVENTION

The general purpose of this invention is to provide a substance smoking device which embraces all of the advantages of smoking device ignitor systems such as is generally known for those noted above, yet possess none of their aforedescribed disadvantages. To attain this, the instant invention contemplates a unique combination of elements comprising a pressurized fuel and a novel delivery system and ignitor embraced within the smoking device, whereby smoker's inconveniences are avoided by providing a smoker a simple way of lighting or relighting his smoking device.

An object of the instant invention is the provision of an improved form of a substance smoking device with a self-contained ignitor system.

Another object is to provide an ignitor device that is positionable to a position within the bowl to facilitate lighting of the substance contained in the bowl and yet positionable out of the bowl when not in use.

A further object is to prevent the odor or taste of ignitor fuel from being present when the taste of the smokable substance is being enjoyed by the smoker.

A further object of the instant invention is to provide a novel means for preventing evaporation of the ignitor fuel when ignition is not required.

Other objects, advantages and capabilities of the instant invention will become apparent from the following detailed description, when taken in conjunction with the accompanying drawings illustrating preferred embodiments of this invention.

BRIEF DESCRIPTION OF THE DRAWINGS

The same reference numerals are used throughout the various drawing figures to denote the identical or like element or part.

FIRST PREFERRED EMBODIMENT

Figure 1:
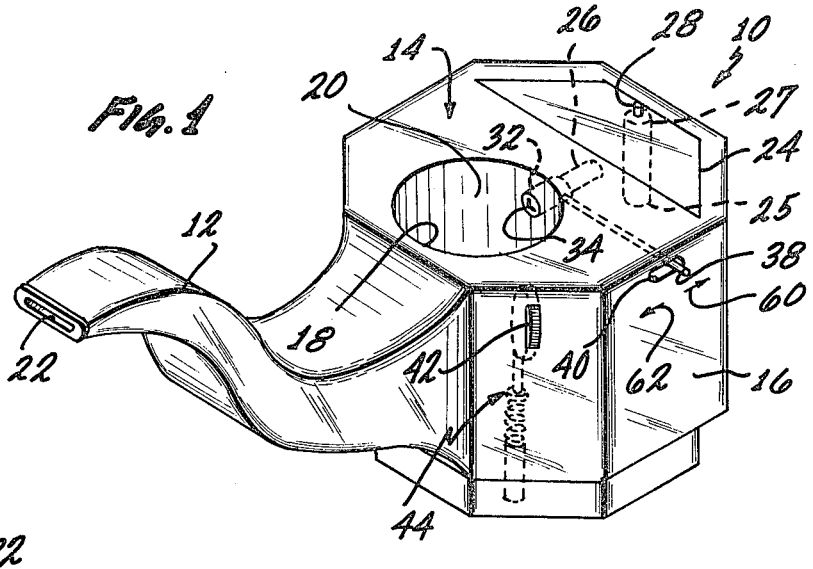
FIG. 1 is a perspective cutaway showing of one embodiment of the device.

FIGS. 1–4 show, by way of example, a conventional smoking pipe 10 with a stem 12 contiguous with a bowl portion 14, which has an outer and inner wall 16, 18 respectively. The inner wall 18 defines a substance containing hollow bowl 20. The bowl 20 communicates with the mouth of the smoker through center stem passage and bowl passage 22.

Confined by inner and outer bowl walls 16, 18 is a fuel container 24 which contains a hydro carbon liquid fuel, such as, but not limited to, butane, propane, etc., confined under pressure. This type of fuel and container are well known in the cigarette lighter art. The fuel container can be externally charged with fuel through filler 25 through passage 27.

Extending from fuel container 24 is a fuel delivery tube 26 which extends from the fuel container to a position adjacent the bowl 20 but yet confined between the outer and inner bowl walls 16, 18 respectively.

Figure 2:
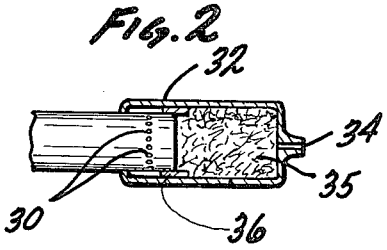
FIG. 2 is an enlarged showing of the fuel delivery tube in a deployed operable position.
Figure 3:
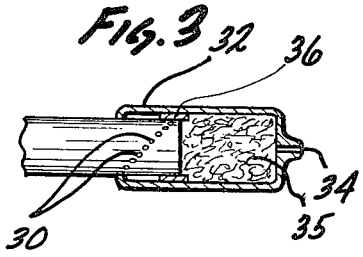
FIG. 3 is an enlarged showing of a second embodiment of a delivery tube in a deployed operable position.
Figure 4:
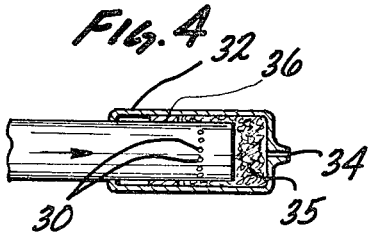
FIG. 4 is an enlarged showing of the fuel delivery tube in a stowed inoperable position.

As shown in FIG. 2, end 28 of this hollow tube 26 is sealed to flow of fuel. Adjacent end 26 around the periphery of the fuel delivery tube 26 are a plurality of apertures 30 through this tube. These apertures 30 provide fuel flow passages. The number of these apertures and their size are chosen having the desired fuel flow in mind. As shown in this figure the apertures 30 are evenly spaced from tube end 26. FIG. 3 shows apertures 30 being unevenly spaced from the end 26. The purpose of the positioning of the apertures either evenly or unevenly spaced from the tube end will hereinafter be discussed in more detail.

Overlaying the delivery tube 26 in a telescoping manner is a combination fuel delivery tube extension and fuel cut-off valve 32. The outside end of this tube 32 is closed except for a centrally located fuel nozzle aperture 34. Contained within and adjacent to its closed end is a quantity of fiberous material 35, such as, for example, fiber glass, fiber wool, etc., for aiding the dispersement of fuel through the aperture nozzle 34. A resilient gasket or tube liner 36 is positioned adjacent the fiberous material 35. This resilient gasket 36 can be fabricated from such material as plastic, natural or synthetic rubber or the like. This resilient gasket 36 has sufficient thickness to ensure the closure of fuel delivery tube aperture 30 when the gasket overlays these apertures as hereinafter discussed.

The telescoping of the combination fuel delivery tube extension and fuel cut-off valve 32 is accomplished by lever arm 38 connected thereto and translatable along slot 40 through walls 16, 18 of the pipe bowl 14. The length of the translation of lever arm 38 is limited by the dimension of the slot 40.

Positioned adjacent the hollow bowl 20 and substantially contained between the outer and inner walls 16, 18, only the edge of the striker wheel 42 being exposed, is an ignitor unit 44. This ignitor unit comprises a conventional striker wheel 42 and a flint container with a flint biased against the striker wheel. The term flint is used to describe conventional man-made and natural existing substances that when rubbed against a corrogated striker wheel will emit sparks for igniting a fuel. The spark emitting portion of the ignitor unit 44 is positioned so that the fuel from nozzle 34 can be readily ignited.

SECOND PREFERRED EMBODIMENT

Figure 5:
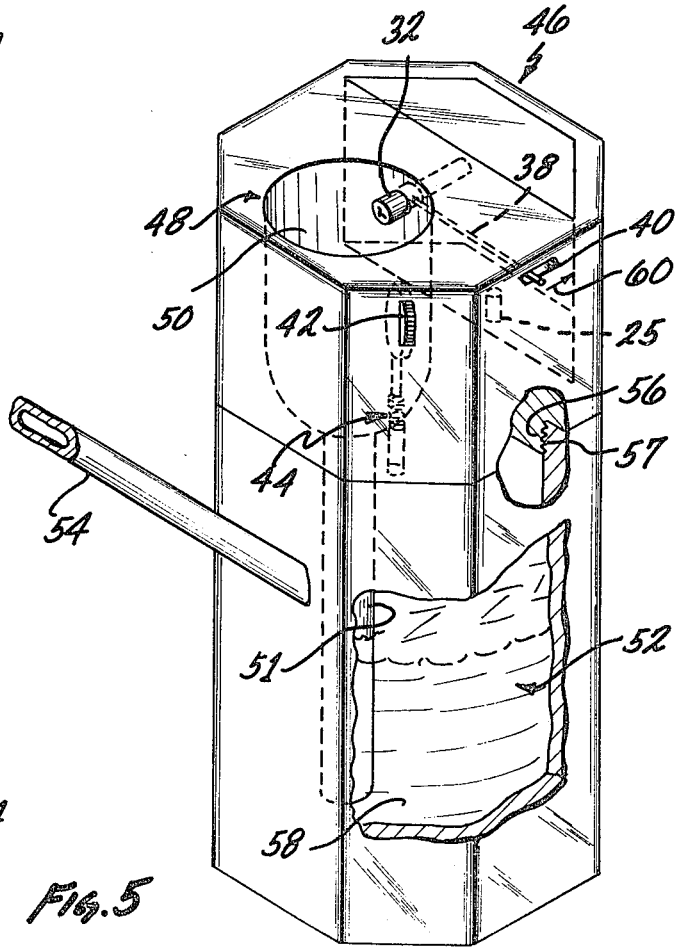
FIG. 5 is a showing of a second embodiment of the smoking device of FIGS. 1–4 employing a fluid reservoir.

Referring now specifically to FIG. 5, a pipe 46 includes a bowl portion 48 with a hollow bowl 50 and a draft tube 51 extending from the hollow bowl to a position below the bowl portion, a removable liquid reservoir 52 wherein the draft tube extends when attached to the bowl portion and a stem 54 attached to the removable liquid reservoir. The stem 54 having a stem passage 22. Threads 56 are provided on the lower surface of the bowl which engage threads 58 on the inner upper surface of the reservoir 52. These threads seal the reservoir to the bowl portion 48 when the device is in use. The liquid generally contained in the reservoir for the purpose of cooling the smoke prior to entering the user's mouth is water, however, various other liquids selected by the user could be used in place of the water to cool and add taste to the smoke.

The walls of the bowl portion 48, like that of bowl portion 14, contain the same ignitor system as hereinbefore described.

An opening 59 is provided in bowl portions 14, 48 to provide a means for refilling the fuel supply from an external supply.

OPERATION OF THE PREFERRED EMBODIMENTS

Prior to the operation or use of the smoking device of the instant invention the lever arm 38 is moved in the direction of arrow 60 until it rests against the end surface of slot 40 in that direction, this places gasket 36 of extension tube 32 over and against apertures 30 sealing off the fuel to nozzle 34. In this position of the extension tube 32 the hollow portion of bowls 20 and 56 are free of all ignitor apparatus and fillable with tabacco or the like. After the bowl is filled with a selected amount of smokable substance the lever arm 38 is moved in the direction of arrow 62 to the opposite end wall of slot 40 thus opening the apertures and allowing fuel to flow through nozzle 34 and positioning the nozzle end of tube 32 at substantially the center of the bowl at a convenient vertical position adjacent the smokable substance. When the fuel is present, the smoker then operates the striker wheel against the flint producing sparks therefrom that ignite the fuel.

After the smokable substance is ignited in a conventional manner, the lever arm 38 is again translated in the direction of arrow 60 until it rests against the opposite side of slot 40 where the fuel flow is again terminated and the tube 32 is again positioned between the bowl walls.

The above described operation pertains to the fuel delivery tube 26 shown in FIG. 2 wherein the apertures 30 through the tube are on the same vertical plane perpendicular with the center line of the tube and equally spaced from the end of the tube. This embodiment provides an off or on fuel delivery condition and the size of the flame at the nozzle 34 is determined by aperture size and number.

As shown in FIG. 3, the fuel delivery tube 26 has apertures that are on an angled plane with respect to the tube center line and are therefore unequally spaced from the end of the tube. Apertures positioned in this manner allow for fuel flow control between fully off and fully on to adjust the flame size by the user of the device.

It should be understood, of course, that the foregoing disclosure relates to only preferred embodiments of the invention and that numerous modifications and/or alterations may be made therein without departing from the spirit and the scope of the invention, it is desired therefore, that only such limitations be placed on the invention as are imposed by the prior art and set forth in the appended claims.

What is claimed is:

1. A smoking device with an improved self-lighting apparatus in combination therewith, said smoking device having an enlarged end structure with a hollow bowl therein for containing a substance to be smoked and a hollow stem attached thereto and communicating with said hollow bowl, said stem having a bit receiving end portion, said apparatus comprising:

a supply of pressurized fuel positioned within said enlarged structure;

a first fixedly positioned fuel delivery tube extending from said supply of pressurized fuel to a position adjacent said hollow bowl and terminating within said enlarged structure;

a second translatable fuel delivery tube engaging a portion of said first fuel delivery tube in a telescoping manner for selectively extending the length of said first fuel delivery tube, said first and second fuel delivery tubes comprise a fuel control valve, said second translatable fuel delivery tube is translatable with respect to said first fuel delivery tube between a first position wherein it is contained within said enlarged structure to a second position wherein it extends into said hollow bowl, said fuel control valve shutting off the supply of fuel through said delivery tubes when said translatable fuel delivery tube is in said first position and opens allowing fuel to flow through said delivery tubes when said translatable fuel delivery tube is in said second position;

translating means for translating said second fuel delivery tube; and an ignitor for igniting said fuel.

2. The invention as defined in claim 1, wherein said supply of pressurized fuel is liquid.

3. The invention as defined in claims 1 or 2, wherein said fuel is a hydro carbon.

4. The invention as defined in claim 1, wherein said second translatable fuel delivery tube telescopes over said first fixedly positioned fuel delivery tube.

5. The invention as defined in claim 1, wherein said second translatable fuel delivery tube is operable externally of said smoking device by a lever attached thereto and positioned substantially perpendicular with the longitudinal center line of said second translatable fuel delivery tube.

6. The invention as defined in claims 1 or 4, wherein the tip of said first fixedly positioned fuel delivery tube is sealed and a plurality of selectively sized fuel passages are provided around the end periphery of said first fixedly positioned delivery tube.

7. The invention as defined in claims 1 or 4, wherein the end of said second translatable fuel delivery tube contains a porous non-flamable material therein to aid in evenly dispersing said fuel.

8. The invention as defined in claim 1, wherein said fuel control valve comprises a lining of resilient material within a portion of the inner wall surface of said second translatable fuel delivery tube.

9. The invention as defined in claim 1, wherein said ignitor comprises a flint and flint striker means.

10. The invention as defined in claim 1, wherein said smoking device further includes a liquid reservoir between said hollow bowl and said hollow stem.

11. The invention defined in claims 1 or 10, wherein said supply of pressurized fuel is refillable from an external supply.

12. The invention as defined in claim 10, wherein said reservoir is separatable from said hollow bowl for refilling.

* * * * *